United States Patent [19]

Hikuma et al.

[11] Patent Number: 4,796,462

[45] Date of Patent: Jan. 10, 1989

[54] WORKPIECE BITE DEVICE IN A ROLLING FLAT CUTTER

[75] Inventors: Hideo Hikuma; Masaji Yamada, both of Hamamatsu, Japan

[73] *Assignee: Fuji Tekko Co., Ltd., Shizuoka, Japan

[21] Appl. No.: 14,531

[22] Filed: Apr. 2, 1987

[30] Foreign Application Priority Data

Aug. 2, 1986 [JP] Japan ..... 61-119120[U]

[51] Int. Cl.[4] ..... B21H 5/00

[52] U.S. Cl. ..... 72/469; 72/88

[58] Field of Search ..... 72/469, 88, 90, 102–104, 72/108

[56] References Cited

U.S. PATENT DOCUMENTS

| | | | |
|---|---|---|---|
| Re. 14,759 | 11/1919 | Wilcox . | |
| 352,365 | 11/1886 | Simonds | 72/469 |
| 1,649,929 | 11/1927 | Senior | 72/90 |
| 1,907,684 | 5/1933 | Thomson | 72/469 |
| 3,105,243 | 1/1962 | Drader . | |
| 3,214,951 | 11/1965 | McCardell . | |
| 3,453,851 | 7/1969 | Morse | 72/469 |
| 3,602,026 | 8/1971 | DeCaro | 72/469 |
| 3,872,699 | 3/1975 | Blue | 72/469 |
| 4,644,772 | 2/1987 | Killop et al. | 72/469 |
| 4,646,549 | 3/1987 | Saito et al. . | |

FOREIGN PATENT DOCUMENTS

| | | | |
|---|---|---|---|
| 42-18746 | 9/1967 | Japan . | |
| 59-209448 | 11/1984 | Japan . | |
| 180635 | 9/1985 | Japan | 72/88 |
| 1075723 | 7/1967 | United Kingdom . | |
| 1470783 | 4/1977 | United Kingdom | 72/90 |

*Primary Examiner*—Daniel C. Crane

*Attorney, Agent, or Firm*—Wenderoth, Lind & Ponack

[57] ABSTRACT

A workpiece bite device having a pinch member provided at a side for biting a workpiece in a pair of flat cutters which are disposed with those working blades facing each other for rolling the workpiece. The pinch member is fitted to a cutter body such that a starting portion of the pinch member is positioned at a side for charging the workpiece rather than a starting portion of the working blades of the cutter body, a terminal portion is positioned at a side of the working blade starting portion of the cutter body, and a top of the pinch member protrudes higher than a top of the working blade starting portion.

11 Claims, 3 Drawing Sheets

WORKPIECE BITE DEVICE IN A ROLLING FLAT CUTTER

BACKGROUND OF THE INVENTION

The present invention relates to a flat cutter for rolling a workpiece which consists of a pipe or solid shaft to press a spline, serration or the like to its periphery, and particularly to a workpiece bite device therein.

Hitherto, as a conventional rolling flat cutter, for example, the following is described in Japanese Patent Laid Open Publication No. 180, 635/85.

Referring to FIG. 1, a conventional flat cutter generally designated by numeral 1 comprises a rectangular solid body 2 which has a plurality of corrugated working blades 3 formed to extend in width on an upper surface thereof, and a flat portion 4 integrally formed to extend in a longitudinal direction at a starting portion 3*a* of the working blades 3. As shown in FIG. 2, a top of the flat portion 4 protrudes higher than the working blades 3, and a chamfer 5 and a slot 6 are formed at both sides of the flat portion 4, respectively.

At the time of working, a pair of flat cutters 1 are disposed with the working blades 3 thereof facing each other, so that a workpiece is charged for rolling between them. Since the flat cutter 1 has the flat portion 4 formed only at the starting portion 3*a* of the working blades 3, the workpiece is pinched by the flat portions 4 of the pair of cutters at the same time that the workpiece is worked by the starting portions 3*a* of the working blades 3. Therefore, there is a problem in that a large load which is produced when the bite of the workpiece starts, causes the displacement of the workpiece at the beginning of rolling and reduces the precision of working.

SUMMARY OF THE INVENTION

It is an object of the present invention to provide a workpiece bite device in a flat cutter which resolves the above-mentioned problem.

It is another object of the invention to provide a workpiece bite device which can hold securely a workpiece then the working blades of the flat cutter begins to bite it.

It is another object of the invention to provide a workpiece bite device which can prevent a workpiece from deforming by lowering the force applied to the workpiece when the working blades of the flat cutter begins to bite it.

These and other objects, features and advantages of the invention will become apparent from the following description taken in connection with the accompanying drawings.

DESCRIPTION OF THE PREFERRED EMBODIMENT

Figure 3:
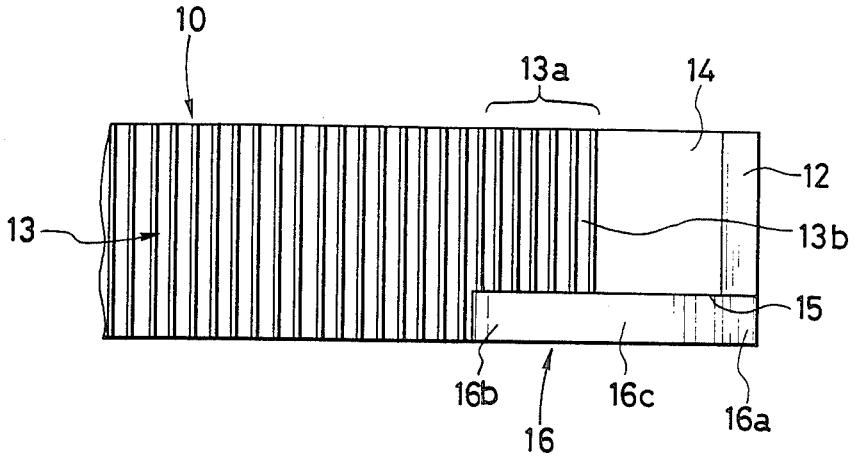
FIG. 3 is a top plan view illustrating a principal part of an embodiment of the invention.
Figure 4:
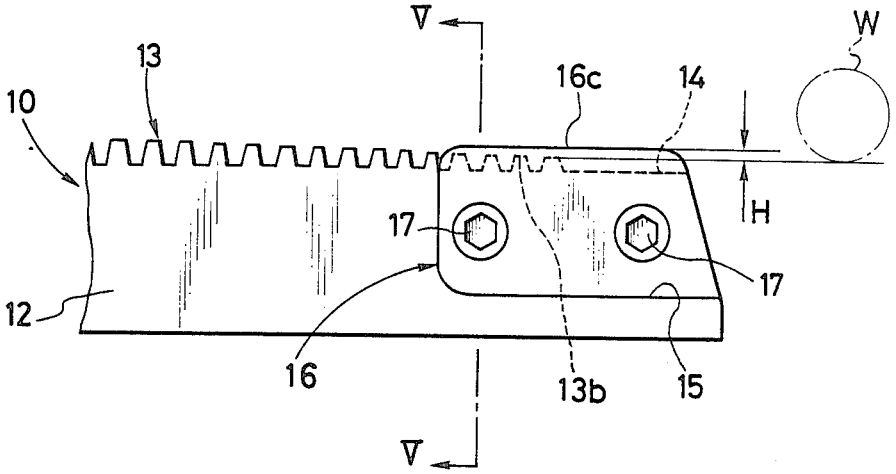
FIG. 4 is a side view of the embodiment of FIG. 4.
Figure 5:
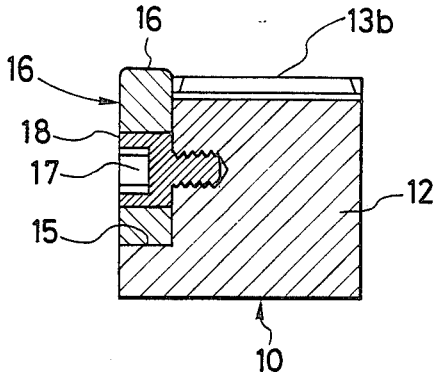
FIG. 5 is a sectional view taken along line V—V in FIG. 4.

Referring to FIGS. 3 to 5, there is shown a lower flat cutter 10 of a pair of flat cutters used on the upper and lower sides.

The flat cutter 10 extending in a longitudinal direction comprises a rectangular solid body 12 which has a plurality of corrugated working blades 13 formed to extend in a widthwise or lateral direction perpendicular to the longitudinal direction on an upper surface thereof. The working surfaces of the working blades 13 increase in height starting from a longitudinal end at which a workpiece is initially bit or engaged on the blades, i.e. the right end, to the left end of the drawing. At the right longitudinal end of the body 12, a charging portion comprising a flat portion 14 is formed by eliminating the working blades 13 such that the working blades extend above the charging portion and a recess comprising a concave portion 15 is formed by cutting out a longitudinal side of the flat portion 14 like a step, in which portion 15 a pinch member 16 having a rectangular plate shape is fitted. The pinch member 16 is made of flexible plastic material, but may be formed of metal material. Thus, a terminal portion 16*b* of the pinch member 16 has a longitudinal side thereof abutting a longitudinal side of a starting portion 13*a* of the working blades 13 over a predetermined distance in the longitudinal direction.

The pinch member 16 is secured to the body 12 through sleeves 18 by a pair of bolts 17 such that a right end or starting portion 16*a* thereof is positioned at a side of the flat portion 14 of the cutter body 12, a left end or the terminal portion 16*b* thereof is positioned at a side of the working blade starting portion 13*a* of the cutter body 12, and a top 16*c* of the pinch member is higher by a height H than a top 13*b* of the working blades 13. The height H is properly set in accordance with the material of the pinch member 16 or a workpiece and the like so that a predetermined pinch force can be produced when the workpiece is processed.

Next, the function of the above mentioned embodiment will be explained.

First, a pair of flat cutters 10 are disposed with the working blades 13 thereof facing each other and a workpiece W is charged between both cutters, thus the cutters 10 are moved parallel with each other from the starting to the terminal portions thereof in opposite directions.

Thus, at first the workpiece W is pinched by the starting portions (the right end 16*a* as shown) of a pair of pinch members 16 to keep the predetermined position. Next, when the terminal portions (the left end 16b as shown) of the pair of pinch members 16 come up, the workpiece W is pinched by the terminal portions and the starting portion 13*a* of the working blades 13 bites the workpiece W. Then, the remaining parts of the working blades 13 sequentially bite the workpiece one after another so as to work it by rolling.

Figure 6:
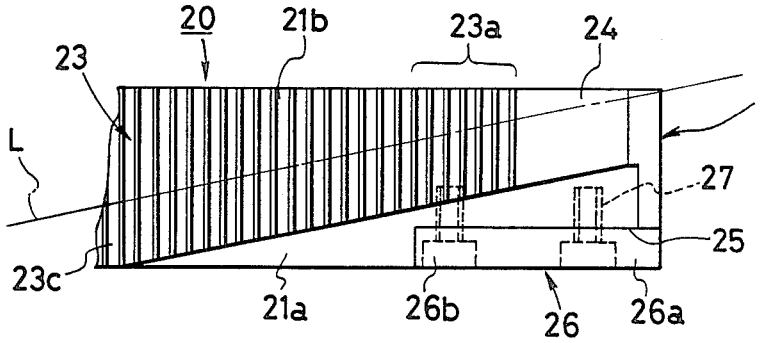
FIG. 6 is a top plan view illustrating a principal part of another embodiment of the invention.
Figure 7:
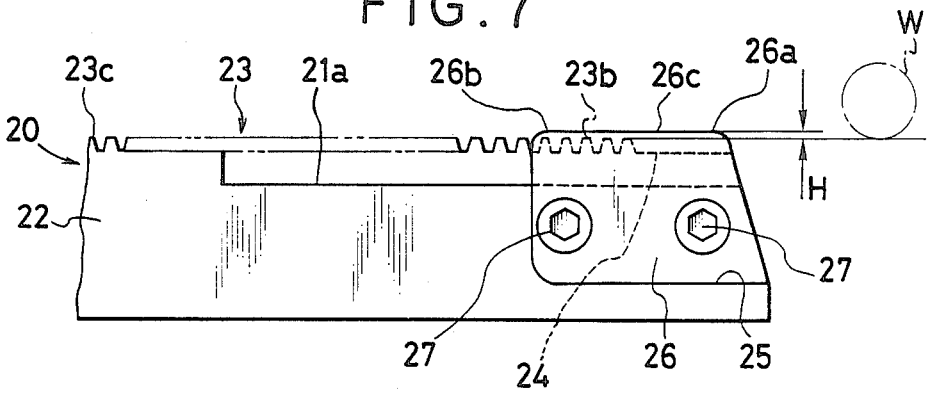
FIG. 7 is a side view of the embodiment of FIG. 8.

FIGS. 6 and 7 illustrate another embodiment of the invention.

Figure 1:
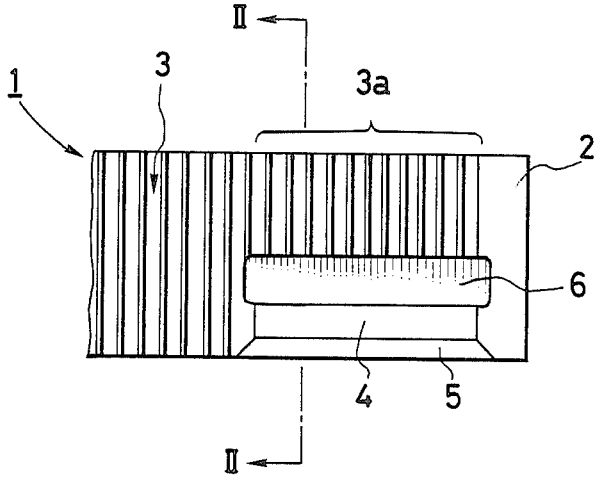
FIG. 1 (PRIOR ART)
FIG. 1 is a top plan view illustrating an example of a conventional rolling flat cutter.
Figure 2:
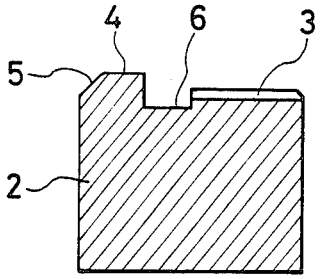
FIG. 2 (PRIOR ART)
FIG. 2 is a sectional view taken along line II—II in FIG. 1.

The flat cutter 20 also comprises a rectangular solid body 22 as in the embodiment of FIGS. 1 to 3. In this embodiment, however, an upper surface of the body 22 is divided by a straight line parallel with a diagonal L of the rectangle into a triangular part 21*a* which is formed lower by a setp on one side (lower side in the drawing) and a higher part 21*b* on the other side, on which part 21*b* a plurality of corrugated working blades 23 are formed to extend in a widthwise direction. The working blades 23 consist of finishing blades which have a constant height from the starting side of a workpiece, i.e. the right side, to the left side. Also, at the right end of the body 22, a flat portion 24 is formed by eliminating the working blades 23 and a concave portion 25 is formed by cutting out a side of the flat portion 24 like a step, in which portion 25 a pinch member 26 as in the embodiment of FIGS. 1 to 3 is fitted.

More specifically, the pinch member 26 is secured to the cutter body 22 by a pair of bolts 27 such that a right end 26*a* of the pinch member is positioned at a side of the flat portion 24 of the cutter body 22, a left end 26*b* is positioned at a side of the working blade starting portion 23a of the cutter body 22, and a top 26*c* of the pinch member is higher by a height H than a top 23*b* of the working blades 23.

According to the embodiment of FIGS. 6 and 7, at the time of working, if a workpiece W is charged between a pair of flat cutters 20 and these cutters are moved parallel with each other from the starting to the terminal portions thereof in opposite directions, then the workpiece W is sequentially worked axially on its periphery by a blade portion which becomes longer in width from the starting portion 23*a* to the terminal portion 23*c*. Therefore, a force applied to the workpiece W by the working blades 23 at the beginning of working is reduced and hence it is possible to prevent the deformation of the workpiece.

While preferred embodiments have been described, the present invention should not be limited thereto and modifications may be made within the scope of the appended claims.

What is claimed is:

1. A workpiece bite device in a rolling flat cutter comprising a cutter body having a width extending in a lateral direction and a length extending in a longitudinal direction, said cutter body having a plurality of corrugated working blades formed on a portion of a surface thereof and a charging portion extending in said longitudinal direction with said charging portion of said surface being free of said working blades, said working blades extending a height above a plane containing said charging portion, means comprising a pinch member provided at one longitudinal side of said cutter body so as not to extend across the width of said cutter body for biting a workpiece with a predetermined pinch force, said pinch member having a starting portion thereof disposed adjacent said charging portion of said surface at which a workpiece is charged into engagement with said flat cutter so that said workpiece fed into said charging portion moves simultaneously along said charging portion and starting portion of said pinch member, a terminal portion of said pinch member being positioned adjacent a starting portion of said working blades of said cutter body such that said terminal portion of said pinch member has a longitudinal side thereof abutting a longitudinal side of said starting portion of said working blades over a predetermined distance in said longitudinal direction so that said workpiece fed within said starting portion of said working blades simultaneously moves along said terminal portion of said pinch member and said starting portion of said working blades, said pinch member having a surface thereof extending outwardly above said plane from said cutter body a distance greater than a working surface height of said starting portion of said working blades.

2. A workpiece bite device according to claim 1, wherein said charging portion of said cutter body comprises a flat portion formed at a longitudinal end of said cutter body for biting said workpiece and said pinch member is fixedly held in a recess formed in said longitudinal side of said cutter body, said pinch member comprising a plate shaped member.

3. A workpiece bite device according to claim 1, wherein each of said working blades increases in height from said starting portion to a terminal portion of said cutter body.

4. A workpiece bite device according to claim 1, wherein said portion of said surface on which said working blades are provided becomes larger in width along said longitudinal direction such that said working blades become progressively longer in a direction away from said starting portion of said working blades.

5. A workpiece bite device according to claim 2, wherein said working blades increase in height from said starting portion to a terminal portion thereof.

6. A workpiece bite device according to claim 2, wherein said working blades are provided on a part formed as a higher step along a straight line parallel with a diagonal of a rectangular plane of said cutter body.

7. A workpiece bite device in combination with a rolling flat cutter having a width which extends in a lateral direction and a length which extends in a longitudinal direction, the workpiece bite device comprising a work bite portion on a work inserting side of a main body of the flat cutter, said main body including a plurality of corrugated working blades having blade surfaces which are parallel with an axis of the workpiece upon rolling machining thereof, the blades being formed on one longitudinally extending surface, wherein:

a portion of said main body having said plurality of working blades arranged thereon comprises a starting portion of said working blades;

a flat portion of said main body comprising a charging portion of said flat cutter free of said working blades is formed longitudinally adjacent to said starting portion of said working blades on the work inserting side such that the working blades extend above a plane containing said flat portion;

a concave portion adjacent to said starting portion of said working blades and adjacent to said flat portion is formed by a recess in one longitudinal side edge of said main body, said recess extending below said plane containing said flat portion; and means for biting a workpiece with a predetermined pinch force comprising a plate-shaped pinch member is attached in said concave portion so as not to extend across the width of the cutter body and such that a top portion of said pinch member which engages said workpiece is protruded higher than upper ends of said working blades provided in the starting portion, said charging portion, pinch member and starting portion of said working blades being oriented in the longitudinal direction so that said workpiece fed into said charging portion moves simultaneously along said charging portion and said pinch member and said workpiece fed within said starting portion of said working blades simultaneously moves along said pinch member and said starting portion of said working blades.

8. A workpiece bite device according to claim 7, wherein said working blades are formed on an upper surface of a base portion of said main body which is formed as a higher step having a width in a direction perpendicular to said longitudinal direction which increases in a direction away from said work inserting side, said work inserting side being adjacent a narrow end of said base portion.

9. A workpiece bite device according to claim 1, wherein said working blades extend in a widthwise direction which is substantially perpendicular to said longitudinal direction and said pinch member has a width in said widthwise direction which is less than a width of said surface of said charging portion.

10. A workpiece bite device according to claim 4, wherein said working blades extend in a widthwise direction which is substantially perpendicular to said longitudinal direction and said pinch member has a width in said widthwise direction which is less than a width of said surface of said charging portion.

11. A workpiece bite device according to claim 7, wherein said working blades extend in a direction perpendicular to said longitudinal direction.

* * * * *